US005310093A

United States Patent [19]

Bennett

[11] Patent Number: 5,310,093

[45] Date of Patent: May 10, 1994

[54] FOAM DISPENSER

[76] Inventor: Robert A. Bennett, 170 Sturbridge Rd., Easton, Conn. 06612

[21] Appl. No.: 25,675

[22] Filed: Mar. 3, 1993

[51] Int. Cl.[5] ..... B67D 5/58

[52] U.S. Cl. ..... 222/190; 222/211; 239/343; 239/590.5

[58] Field of Search ..... 222/190, 211, 206, 212, 222/564; 239/343, 327, 590.5, 428.5

[56] References Cited

U.S. PATENT DOCUMENTS

| | | | |
|---|---|---|---|
| 3,100,067 | 8/1963 | Heppenstall | 222/190 |
| 3,401,845 | 9/1968 | Bach | 239/327 X |
| 3,973,701 | 8/1976 | Gardner | 222/190 |
| 4,087,023 | 5/1978 | Szczepanski | 239/327 X |
| 4,147,306 | 4/1979 | Bennett | 239/343 X |
| 4,156,505 | 5/1979 | Bennett | 239/343 X |
| 4,836,422 | 6/1989 | Rosenberg | 222/190 |
| 5,064,103 | 11/1991 | Bennett | 222/190 |
| 5,197,636 | 3/1993 | Mitchell et al. | 222/190 |

FOREIGN PATENT DOCUMENTS

| | | | |
|---|---|---|---|
| 1059363 | 2/1955 | Fed. Rep. of Germany | 239/327 |

*Primary Examiner*—Andres Kashnikow
*Assistant Examiner*—Anthoula Pomrening

[57] ABSTRACT

A vertical hollow cylinder has an open bottom end and a closed top end having a first opening. A vertical hollow tube is open at both ends. A vertical inverted truncated hollow cone is open at both ends. The smaller open end of the cone is connected to the upper open end of the tube. A vertical cup shaped element has a first flat horizontal surface having a central hole coincident with the larger cone end and containing a plurality of small holes spaced from each other and from the central hole. The element has a second flat horizontal surface spaced slightly above the first surface and disposed around the central hole and the small holes. The top surface of the element engages the top end of the cylinder, the tube, cone and element being aligned with the first opening. A flat flexible disc has a flapper valve disposed in its center aligned with the first opening and also has a plurality of short vertical flexible fingers closely spaced from each other. The fingers are secured at lower ends to the disc and extend upward. The disc is disposed in the element and rests on the second horizontal surface with the prongs extending upward to engage the top end of the cylinder. The disc is separated from the first horizontal surface thereby defining a plurality of flat narrow horizontal channels.

5 Claims, 2 Drawing Sheets

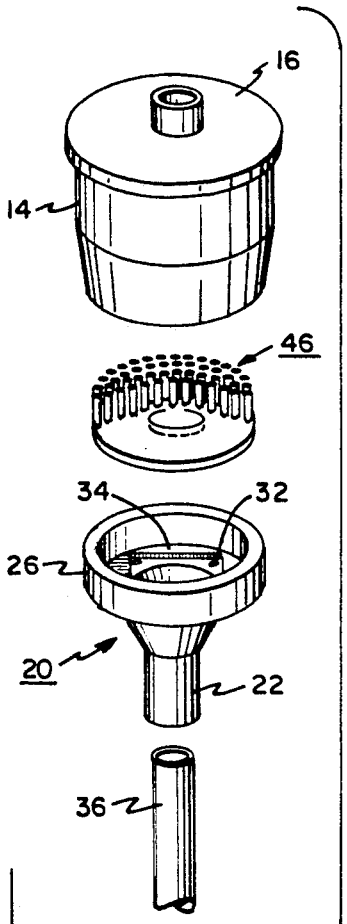
FIG. 1
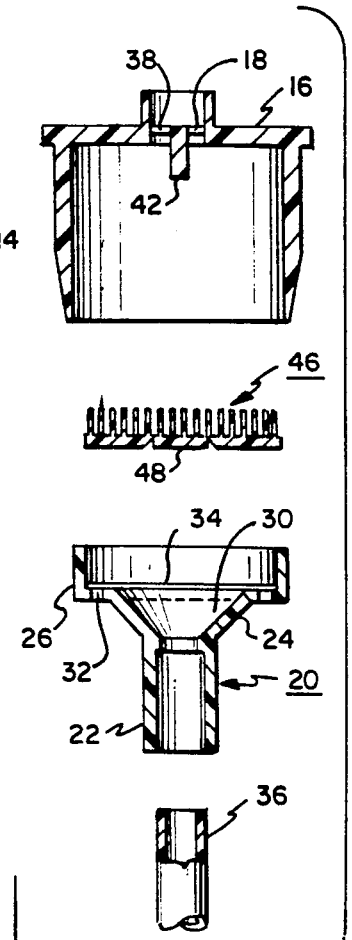
FIG. 2
FIG. 3A
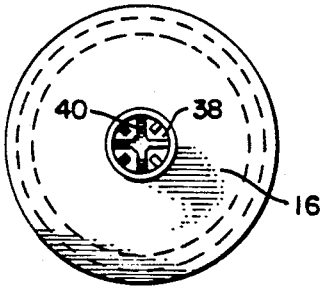
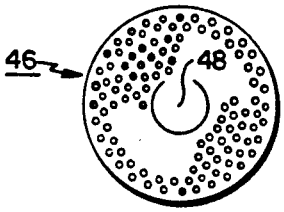
FIG. 3B
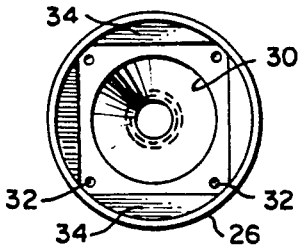
FIG. 3C
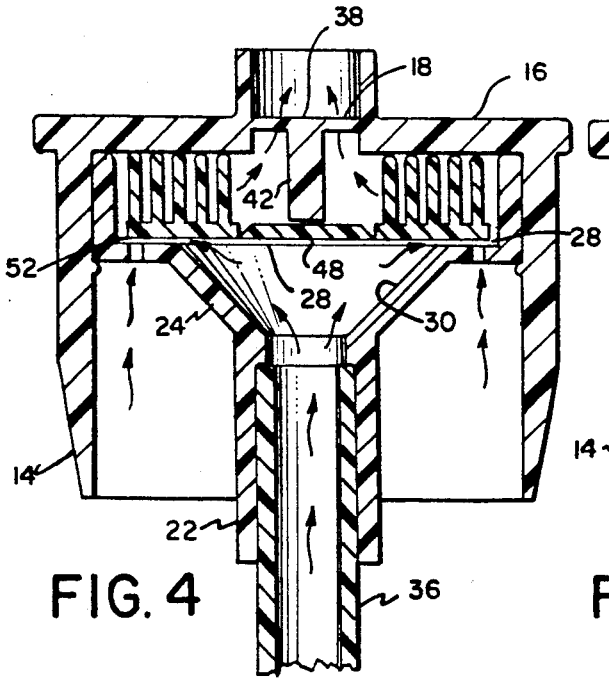
FIG. 4
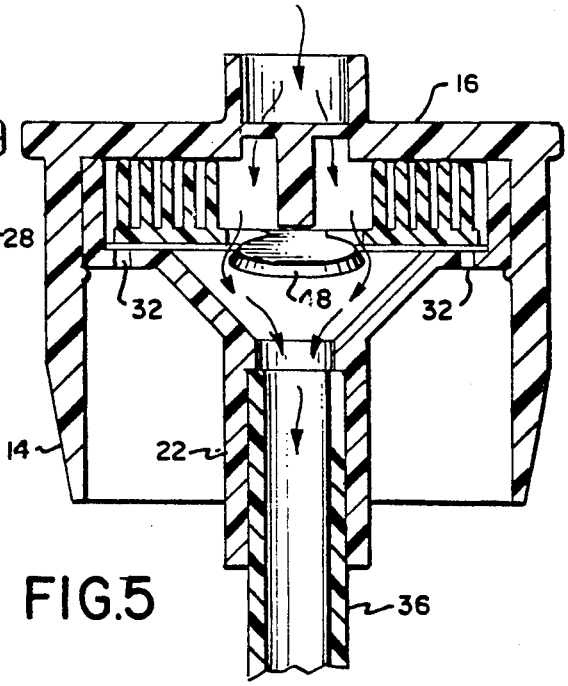
FIG.5

FOAM DISPENSER

BACKGROUND OF THE INVENTION

Foam dispensers typically employ a squeezable container filled with air and a defoamable liquid, a discharge device with a discharge orifice and a foam producing structure disposed in the container and connected to the discharge device. The structure contains a mixing chamber. When the container is squeezed, liquid and air are mixed together in the mixing chamber. The mixture of air and liquid is passed through a filter to produce foam. The device transports the foam to the discharge orifice for discharge.

The present invention is directed toward a new type of foam dispenser wherein a novel attachment readily manufactured and easily installed in a squeezable container filled with air and a foamable liquid enables the container when squeezed to produce an enhanced mixing action of air and liquid, whereby a very thick adherent foam is produced. The attachment contains a very small number of components and is easily manufactured at low cost.

SUMMARY OF THE INVENTION

Accordingly, it is an object of the present invention to provide a new and improved attachment adapted to be inserted into a squeezable container having air and liquid therein whereby when the container is squeezed, a very thick adherent foam is produced.

Another object is to provide a new and improved foam dispenser characterized by producing an enhanced air and liquid mixing action, resulting in the discharge of a very thick adherent foam.

These and other objects and advantages of this invention will either be explained or will become apparent hereinafter.

In accordance with the principles of this invention, a foam dispenser employs an elongated squeezable container with air and a foamable liquid therein and having an open neck. An attachment is utilized with the container.

The attachment includes a vertical hollow cylinder having an open bottom end and a closed top end with a first opening therein. The cylinder is disposed in the open neck with the closed end exposed.

The attachment further includes a first member having in integral connection: a first vertical hollow tube open at both ends; an inverted truncated hollow cone open at both ends, the smaller open end of the cone being connected to the adjacent open end of the tube, the larger open end of the cone being disposed above said smaller open end; and a vertical cup shaped element having a first flat horizontal surface having a central hole coincident with said larger upper end and a first plurality of small holes spaced from each other and from the central hole.

The element has a second flat horizontal surface spaced slightly above the first surface and disposed adjacent the central hole and small holes. The first member is inserted within the cylinder with the top surface of the cup engaging the top end of the cylinder. The tube, cone and element are all aligned with the first opening;

A second flexible hollow dip tube is disposed in the container. One end of the second tube is secured in the first tube;

The attachment further includes a second flat member disposed in the first opening and having a second plurality of small separated holes therein. The second member has a vertical post extending downwardly from the center thereof.

The attachment still further includes a flat flexible disc having a flapper valve disposed in the center thereof and also having a plurality of short vertical flexible fingers secured at lower ends to the disc and extending upward therefrom. The disc is disposed in the element and rests on said second horizontal surface with the prongs extending upward to engage the top end of the cylinder. The flapper valve is aligned with the first opening with the post engaging the flapper valve. The disc is separated from the first horizontal surface thereby defining a plurality of flat narrow horizontal channels.

When the container is squeezed, air in the container is forced upward through the small holes and maintains the flap valve closed. The liquid is forced upwardly through the tubes and cone and is conducted through the flat channels to combine with the air. The liquid flows through the channels with considerable force, so that as the liquid reaches the end of each channel and engages the air, the air and liquid are violently combined. This combination of air and water is converted into foam as it is forced around the prongs. The foam is thickened as it passes upwardly though the first member and is discharged as a thick foam which adheres to any surface to which it is applied. When the squeezing pressure is released, the return air opens the flapper valve downwards and flows downwardly through the cone and the tubes into the container, thus returning the container to its original unsqueezed state.

BRIEF DESCRIPTION OF THE DRAWINGS

FIG. 1 is a perspective exploded view of the attachment in accordance with the invention.

FIG. 2 is an exploded view in vertical cross section of the attachment shown in FIG. 1.

FIG. 3 is an exploded top view of the attachment shown in FIG. 1.

FIG. 4 is a vertical cross section illustrating the action of the attachment during discharge of foam.

FIG. 5 is a vertical cross section illustrating the action of the attachment after squeezing pressure has been released.

DETAILED DESCRIPTION OF PREFERRED EMBODIMENTS

Figure 6:
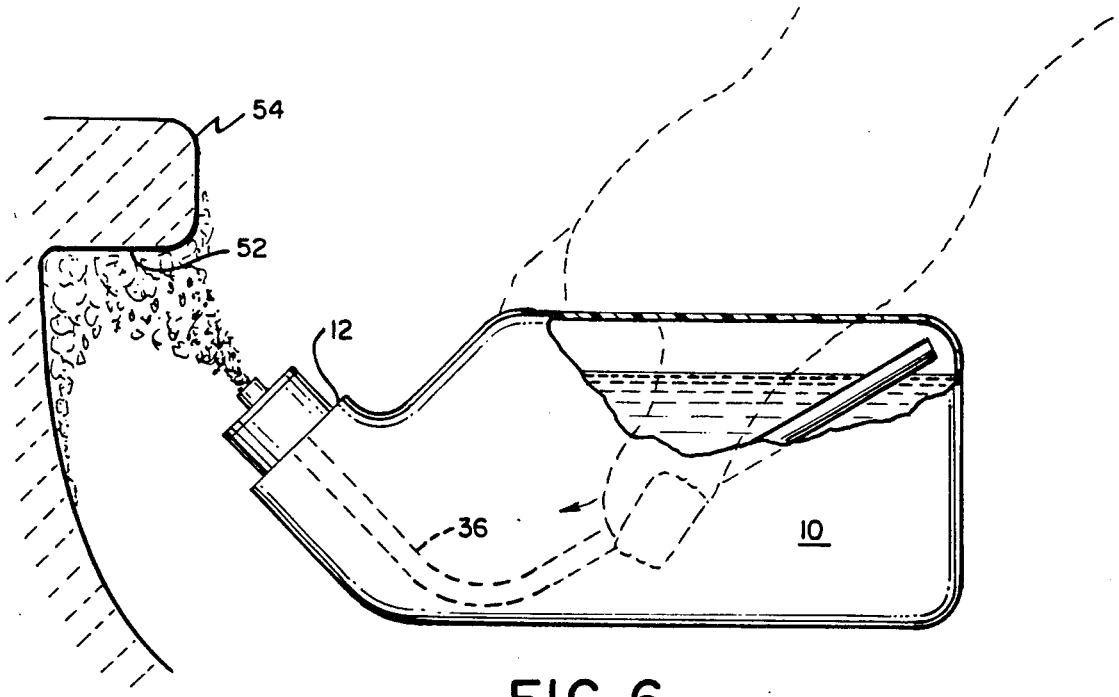
FIG. 6 is a partially cut away view illustrating in use a container with the attachment in position therein.

Referring now to FIGS. 1–6, an elongated squeezable container 10 with air and a foamable liquid therein has an open neck 12.

A vertical hollow plastic cylinder 14 has an open bottom end and a closed top end 16 with a first opening 18 therein. The cylinder is disposed in the open neck with the closed end exposed. Typically, opening 18 can be about two hundredths of an inch in diameter and the cylinder can be about five eighths of an inch high with a diameter of about three fourths of an inch.

A first plastic member 20 has in integral connection: a first vertical hollow tube 22 open at both ends; an inverted truncated hollow cone 24 open at both ends, the smaller open end of the cone being connected to the adjacent open end of the tube, the larger open end of the cone being disposed above said smaller open end; and a vertical cup shaped element 26 having a first flat horizontal surface 28 having a central hole 30 coincident with said larger upper end and a first plurality of four small holes 32 spaced at each of the four corners of a square and equidistantly spaced from the central hole.

Typically, the central hole 30 can be about one half inch in diameter while each of the small holes 32 can be about thirty two thousandths of an inch. Element 26 has a second flat horizontal surface 34 spaced slightly above the first surface and disposed adjacent the central hole and small hole 32. The cup can be about three sixteenths of an inch deep. The tube, cone and element are aligned with the first opening 18.

A flexible hollow plastic dip tube 36 is disposed in the container, one end of the dip tube 36 is secured in the first tube 22. Typically the outer diameter of tube 36 is approximately equal to the inner diameter of tube 22, which is about sixteen thousandths of an inch.

A second flat plastic member 38 disposed in the first opening has a second plurality of small separated holes 40 therein and a vertical post 42 extending downwardly from the center thereof. A second small vertical hollow plastic cylinder 44 is open at both ends, the bottom end of the second cylinder being coincident with opening 18.

A flexible plastic disc 46 has a flapper valve 48 disposed in the center thereof and also has a plurality of short vertical flexible fingers 50 secured at lower ends to the disc and extending upward therefrom. The valve 48 typically is about one eighth of an inch in diameter. Each of these fingers typically has a length somewhat less that the depth of the cup and has a diameter of about three thousandths of an inch. The fingers are spaced about one and one half thousandths of an inch apart.

The disc is disposed in the element and rests on said second horizontal surface with the prongs extending upward to engage the top end of the cylinder and the flapper valve being aligned with the first opening. The post engages the flapper valve.

The disc is separated from the first horizontal surface thereby defining a plurality of flat narrow horizontal channels 52.

When the container is squeezed, air in the container is forced upward through the small holes 32 and maintains the flap valve closed while liquid is forced upwardly through the tubes and cone and is conducted through the flat channels to combine violently with the air. The combined air and water is mixed into foam as it is forced around the prongs and is thickened and becomes more adherent as it passes upwardly though the first member and is discharged. When the squeezing pressure is released, the return air opens the flapper valve downwards and flows downwardly through the cone and the tubes into the container.

Best results are obtained when the channels are about one ten thousandths of an inch deep. As the depth is increased, the amount of air in the mixture increases and the depth is decreased, the amount of liquid increases. Too much air or too much liquid in the mixture will impair or destroy the foam.

Thick adherent foam is particularly useful in cleaning the inner surface 52 of the ledge 54 of a toilet bowl, since the foam will remain in position for a reasonable period after application, thereby facilitating cleaning.

While the invention has been described with particular reference to the drawings and the detailed description, the protection sought is to be limited only by the terms of the claims which follow.

What is claimed is:

1. An attachment adapted to be inserted into the open neck of an elongated squeezable container having air and a foamable liquid therein whereby when the container is squeezed, the attachment converts the air and liquid to a thick foam, said attachment comprising:

a vertical hollow cylinder having an open bottom end and a closed top end with a first opening therein;

a vertical hollow tube open at both ends;

a vertical inverted truncated hollow cone open at both ends, the smaller open end of the cone being connected to the upper open end of the tube, the larger open end of the cone being disposed above said smaller open end;

a vertical cup shaped element having a first flat horizontal surface having a central hole coincident with said larger open end of said cone and a first plurality of small holes spaced from each other and from the central hole, said element having a second flat horizontal surface spaced slightly above the first surface and disposed around the central hole and the first plurality of small holes, the top surface of the element engaging the top end of the cylinder; the tube, cone and element being aligned with the first opening; and a flat flexible disc having a flapper valve disposed in the center thereof and also having a plurality of short vertical flexible fingers closedly spaced from each other, the fingers being secured at lower ends to the disc and extending upward therefrom, said disc being disposed in the element and resting on said second horizontal surface with the prongs extending upward to engage the top end of the cylinder and the flapper valve being aligned with the first opening, the disc being separated from the first horizontal surface thereby defining a plurality of flat narrow horizontal channels.

2. The attachment of claim 1 further including a flat member disposed in the first opening and having a second plurality of small separated holes therein.

3. The attachment of claim 2 wherein the flat member has a downwardly extending vertical post engaging the flapper valve.

4. The attachment of claim 3 further including a second small vertical hollow cylinder open at both ends, the bottom end of the second cylinder being coincident with said first opening.

5. An attachment adapted to be inserted into the open neck of an elongated squeezable container having air and a foamable liquid therein whereby when the container is squeezed, the attachment converts the air and liquid to a thick foam, said attachment comprising:

a vertical hollow cylinder having an open bottom end and a closed top end with a first opening therein;

a first vertical hollow tube open at both ends;

a vertical inverted truncated hollow cone open at both ends, the smaller open end of the cone being connected to the upper open end of the first tube, the larger open end of the cone being disposed above said smaller open end;

a vertical cup shaped element having a first flat horizontal surface having a central hole coincident with said larger open end of said cone and a first plurality of small holes spaced from each other and from the central hole, said element having a second flat horizontal surface spaced slightly above the first surface and disposed around the central hole and the first plurality of small holes, the top surface of the element engaging the top end of the cylinder, the first tube, cone and element being aligned with the first opening;

a second flexible hollow dip tube disposed in the container, one end of the second tube being secured in the first tube;

a flat member having a second plurality of small separated holes therein disposed in the first opening, the flat member having a vertical post extending downwardly from the center thereof; and a flat flexible disc having a flapper valve disposed in the center thereof and also having a plurality of short vertical flexible fingers secured at lower ends to the disc and extending upward therefrom, said disc being disposed in the element and resting on said second horizontal surface with the prongs extending upward to engage the top end of the cylinder and the flapper valve being aligned with the first opening, the post engaging the flapper valve, the disc being separated from the first horizontal surface thereby defining a plurality of flat narrow horizontal channels.

* * * * *